US007921660B2

(12) United States Patent
Brody

(10) Patent No.: US 7,921,660 B2
(45) Date of Patent: Apr. 12, 2011

(54) SYSTEM AND METHOD FOR CONTROLLING DEFROST CYCLES OF A REFRIGERATION DEVICE

(75) Inventor: Chaim Brody, Rehovot (IL)

(73) Assignee: Brody Engineering Ltd., Rehovot (IL)

( * ) Notice: Subject to any disclaimer, the term of this patent is extended or adjusted under 35 U.S.C. 154(b) by 742 days.

(21) Appl. No.: 11/915,381

(22) PCT Filed: May 25, 2006

(86) PCT No.: PCT/IL2006/000619

§ 371 (c)(1),
(2), (4) Date: Nov. 25, 2007

(87) PCT Pub. No.: WO2006/126203

PCT Pub. Date: Nov. 30, 2006

(65) Prior Publication Data

US 2008/0202131 A1 Aug. 28, 2008

(30) Foreign Application Priority Data

May 26, 2005 (IL) ..... 168812

(51) Int. Cl.
*F25D 21/00* (2006.01)
*F25D 21/06* (2006.01)
*F25D 21/08* (2006.01)

(52) U.S. Cl. ..... 62/155; 62/80; 62/151; 62/154; 62/234; 62/276

(58) Field of Classification Search ..... 62/80, 151, 62/154, 155, 234, 276
See application file for complete search history.

(56) References Cited

U.S. PATENT DOCUMENTS

| | | | | |
|---|---|---|---|---|
| 5,440,893 | A | 8/1995 | Davis et al. | |
| 5,493,867 | A | 2/1996 | Szynal et al. | |
| 5,816,054 | A | 10/1998 | Yoo et al. | |
| 6,138,464 | A * | 10/2000 | Derosier et al. | 62/155 |
| 6,148,623 | A | 11/2000 | Park et al. | |
| 6,668,566 | B2 | 12/2003 | Brun et al. | |
| 6,892,546 | B2 * | 5/2005 | Singh et al. | 62/127 |
| 2002/0088238 | A1 | 7/2002 | Holmes et al. | |
| 2003/0084672 | A1 | 5/2003 | Pham et al. | |

* cited by examiner

*Primary Examiner* — Cheryl J Tyler
*Assistant Examiner* — Jonathan Bradford
(74) *Attorney, Agent, or Firm* — Mark M. Friedman

(57) ABSTRACT

Methods, systems and computer readable code for controlling a defrost cycle of a refrigeration device are disclosed. According to some embodiments, a defrost command is issued to a defrost heater at a time determined at least in part by a total wasted energy parameter of the compressor for at least one time interval. In some embodiments, time interval includes a plurality of runtimes, and the total wasted energy parameter of a runtime is measured relative to a chosen reference runtime such as a minimum energy runtime after a defrost or an early runtime after a defrost. Optionally, a sequence of wasted energy parameters of the compressor for a sequence of time intervals is analyzed, and then a correction is performed on at least one wasted energy parameter.

15 Claims, 5 Drawing Sheets

SYSTEM AND METHOD FOR CONTROLLING DEFROST CYCLES OF A REFRIGERATION DEVICE

FIELD OF THE INVENTION

The present invention generally relates to refrigerated devices having cooled enclosures such as refrigerators, freezers and refrigerated display cases.

BACKGROUND OF THE INVENTION

Commercial and domestic refrigerators and freezers are provided with a refrigeration unit for cooling. The refrigeration unit typically has a compressor driven by a compressor motor, a condenser and an evaporator. As the refrigeration unit operates, water vapor condenses on the evaporator and results in the build-up of frost and ice on the evaporator. The build-up of frost and ice on the evaporator results in diminished airflow through the evaporator and a reduction in the ability of the refrigeration unit to cool the air within the refrigerator or freezer. Furthermore, the buildup of frost and ice on the evaporator reduces the rate of heat transfer between the evaporator and the air. To enhance the efficiency of refrigerators and lower their power consumption, many refrigerators are designed to periodically defrost the evaporator. Defrost devices, such as heaters, are often used to hasten the defrost operation. Also known are refrigerators that defrost on demand by computing a parameter indicative of an accumulation of ice and, in response, initiate a defrost operation.

In order to reduce the cost of operation per unit time, it is important to judiciously choose the time of defrost. In the event that the refrigerated device is defrosted more often than necessary, the cost of unnecessary defrosting is incurred. Conversely, defrosting less often than warranted leads to an accumulation of too much frost on the evaporator, which concomitantly reduces the efficiency of any compressor cycle, leading to excessive compressor runtimes, and raising the operating cost of the refrigeration device.

There is an ongoing need for methods and systems for controlling defrost cycles of refrigeration units. Current techniques have, unfortunately, produced unsatisfactory solutions in many situations, leading to excessive operating costs of refrigeration devices.

For example, techniques that rely on extrapolating historical compressor cycle and/or defrost data to the present and future can produce inaccurate solutions when the historical data is non-recurring.

The cumulative time method involves monitoring of the cumulative time a compressor is run during a cooling interval. The interval between defrost cycles is then varied based on the cumulative time the compressor is run and/or the elapse time since a previous defrost. Unfortunately, the cumulative time method fails in environments where there is little or no need to run a defrost cycle, such as low humidity environments or environments where there is little or no door opening. In these situations, there is little or no frost accumulation on the evaporator, yet the compressor continues to run, and the refrigeration device executes unnecessary defrost cycle, leading to an unnecessarily elevated cost of operation.

Other techniques analyze and compare the length of one or more defrost cycles or runtimes. Thus, compressor cycles with an increased compressor runtime, according to some of these techniques, are considered indicative of a less efficient compressor cycle due to frost buildup on the evaporator. Thus, according to these techniques, these longer individual compressor runtimes can trigger a defrost cycle. Unfortunately, longer individual compressor runtimes can be indicative of a number of situations, including a need to defrost as well as other factors, such as a door to the device being open for an unusually long time and/or placement of a warm product within the device. Although certain patches have been suggested to this solution, such as explicitly measuring time that the door is open and incorporating into the defrost algorithm, the basic problem of using erroneous defrost indications remains.

Below is a list of U.S. Patents and US published patent applications providing potentially relevant background art. Each of these U.S. Patents and US published patent applications are incorporated herein by reference. U.S. Pat. No. 5,816,054; U.S. Pat. No. 5,493,867; U.S. Pat. No. 5,440,893; U.S. Pat. No. 6,668,566; US 20020088238; US20030084672.

There is an ongoing need for methods and systems for controlling defrost cycles of refrigeration units. Preferably, these methods and systems would include a correction mechanism for appropriately treating potentially erroneous defrost indications such as long compressor runtimes due to placing of warm foods or beverages within the refrigerator unit.

SUMMARY OF THE INVENTION

The aforementioned needs are satisfied by several aspects of the present invention.

It is now disclosed for the first time method of defrosting a refrigeration unit having a compressor, a defrost heater and an evaporator. The presently-disclosed method includes deriving a total wasted energy parameter of the compressor for at least one time interval and at a time determined at least in part by the derived total wasted energy of the compressor issuing a defrost command to the defrost heater.

In some embodiments, the deriving of the total wasted energy includes choosing a reference runtime, estimating an expended energy parameter of the compressor during the reference runtime, and for a plurality of later runtimes, incrementing the total wasted energy parameter by a difference between the expended energy parameter of the compressor during the later runtime and the expended energy parameter of the compressor during the reference runtime.

In some embodiments, the reference runtime is chosen to be a minimum energy runtime after a previous defrosting of the refrigeration unit such as a minimum energy runtime after a most recent defrosting of the refrigeration unit.

In some embodiments, the choosing of the minimum energy runtime includes designating a runtime to be a candidate minimum energy runtime, deriving an expended energy parameter of a runtime later than the candidate runtime, and if the expended energy parameter of the later runtime is less than an energy parameter of the candidate minimum energy runtime, designating the later runtime as the minimum energy runtime.

In some embodiments, upon designating the later runtime as the minimum energy runtime, the total wasted energy parameter is reset. In some embodiments, the total wasted energy parameter is rest to a predetermined constant such as to zero.

In some embodiments, the reference runtime is chosen to be a runtime having an expended energy parameter that is equal to an expended energy parameter of a minimum energy compression cycle after a previous defrosting of the refrigeration unit such as a most recent defrosting of the refrigeration unit within a specific tolerance. In some embodiments, this tolerance is chosen to be 30%.

In some embodiments, the reference compressor cycle is a chosen to be an early compressor cycle after a previous defrosting of the refrigerator.

In some embodiments, the at least one time interval includes a plurality of compressor cycles.

In some embodiments, the issuing time of the defrost command is determined at least in part by a time that the total wasted energy is at least substantially equal to a first predetermined value.

There is no limitation on the specific time when this first value is predetermined. In some embodiments, the first value is predetermined before operation of the refrigeration unit. In some embodiments, the first value is predetermined during operation of the refrigeration unit. In some embodiments, the first value is predetermined after a most recent defrost cycle.

In some embodiments, the first predetermined value is within 30% of a defrost energy parameter of the refrigerator.

In some embodiments, the command is only issued if a cumulative compressor runtime since a previous defrost is at least substantially equal to a second predetermined value.

In some embodiments, the second predetermined value is at least about 3 hours and at most about 7 hours.

In some embodiments, the method further includes analyzing a sequence of wasted energy parameters of the compressor for a sequence of the time intervals, and performing a correction on at least one the wasted energy parameter.

In some embodiments, the analysis of the wasted energy parameters includes identifying a wasted energy parameter whose value is indicative of factors other than frost accumulation.

In some embodiments, the analysis of the wasted energy parameters includes identifying if any later wasted energy parameter is less than any earlier wasted energy parameter.

In some embodiments, the correction includes reducing a value of the earlier wasted energy parameter.

In some embodiments, the reducing of the value includes reducing the earlier wasted energy parameter to be at most substantially equal to the earlier wasted energy parameter.

In some embodiments, the reducing of the earlier wasted energy parameter includes setting the earlier wasted energy parameter to an interpolated value of other wasted energy parameters.

In some embodiments, the method further includes performing a correction on the total wasted energy parameter.

In some embodiments, the sequence of time intervals includes a sequence of compressor cycles, and the correction includes reducing an inappropriately large wasted energy parameter.

In some embodiments, the total wasted energy parameter is indicative of wasted compressor energy due to frost accumulation on the evaporator.

It is now disclosed for the first time a defrost cycle controller for a refrigeration system including a compressor and a defrost heater. The presently disclosed controller includes a compressor monitor operative to derive a total wasted energy parameter of the compressor for at least one time interval and a command dispatcher adapted to issue defrost commands to the defrost heater at a time determined at least in part by the derived total wasted energy of the compressor.

It is now disclosed for the first time a refrigeration system including a compressor, a defrost heater, and the aforementioned defrost cycle controller.

It is now disclosed for the first time a computer readable storage medium having computer readable code embodied in computer readable storage medium. The computer readable code includes instructions for deriving a total wasted energy parameter of a compressor of a refrigeration unit for at least one time interval, at a time determined at least in part by said derived total wasted energy of the compressor issuing a defrost command to a defrost heater of said refrigerator.

It is now disclosed for the first time a method of defrosting a refrigeration unit having a compressor and a defrost heater. The presently disclosed method includes deriving a function of a plurality of wasted compressor runtimes, and at a time determined at least in part by the derived function issuing a defrost command to the defrost heater.

In some embodiments, the function is an aggregation function.

In some embodiments, the aggregation function is a sum of the wasted compressor runtimes such as a weighted sum of the wasted compressor run times.

It is now disclosed for the first time a computer readable storage medium having computer readable code embodied in said computer readable storage medium, said computer readable code comprising instructions for deriving a function of a plurality of wasted compressor runtimes of a compressor of a refrigeration unit; at a time determined at least in part by the derived function issuing a defrost command to a defrost heater of the refrigeration unit.

It is now disclosed for the first time a defrost cycle controller for a refrigeration system including a compressor and a defrost heater. The presently disclosed controller includes a compressor monitor operative to derive a function of a plurality of wasted compressor runtimes of the compressor for at least one time interval, and a command dispatcher adapted to issue defrost commands to the defrost heater at a time determined at least in part by the derived function.

It is now disclosed for the first time a refrigeration system including a compressor, a defrost heater, and the aforementioned defrost cycle controller.

These and further embodiments will be apparent from the detailed description and examples that follow.

DETAILED DESCRIPTION OF THE INVENTION

Embodiments of the present invention provide methods, apparatus and computer readable code for defrost control of a refrigeration unit. In some embodiments, a command is sent to a defrost heater at a time determined at least in part by a total wasted energy parameter of the compressor for at least one time period.

For convenience, certain terms employed in the specification, examples, and appended claims are collected here.

As used herein, a "wasted energy parameter of the compressor" is a parameter related to an amount of energy wasted by the compressor due to accumulation of frost on the evaporator. In some embodiments, energy wasted by the compressor is due to compressor runtimes that are longer than they would be in the frost free condition.

A "total wasted energy parameter" is the wasted energy parameter totaled over one or more intervals of times, such as, for example, one or more compressor cycles or runtimes. In some embodiments, the "wasted energy parameter of the compressor" or "total wasted energy parameter of the compressor" is linearly related to the actual energy wasted by the compressor.

As used herein, an "expended energy parameter of the compressor" is a parameter related to an amount of energy expended by the compressor during a certain period of time, such as, for example, during a compressor run time. In some embodiments, this relationship is linear.

There are a number of techniques for determining wasted energy parameters and/or expended energy parameters of a time interval, such as a compressor run time. In some embodiments, an expended energy parameter of a compressor runtime is related to the length of the runtime. In some embodiments, this relation is a linear relation. In some embodiments, an expended energy parameter of the compressor for one or more time intervals is related to the total amount of compressor runtime during the one or more time intervals. In some embodiments, this relation is a linear relation.

Alternatively or additionally, expended energy parameters and/or wasted energy parameters of the compressor can be determined by measuring total current through the compressor during one or more time intervals of interest.

In some embodiments, a total wasted energy parameter during one or more time intervals is related to the extra amount of time the compressor was running during the one or more time intervals due to the accumulation of frost on the evaporator. In some embodiments, this relation is a linear relation.

It is noted that exemplary techniques for deriving a total wasted energy parameter are presented in FIGS. 1-4.

Figure 1:
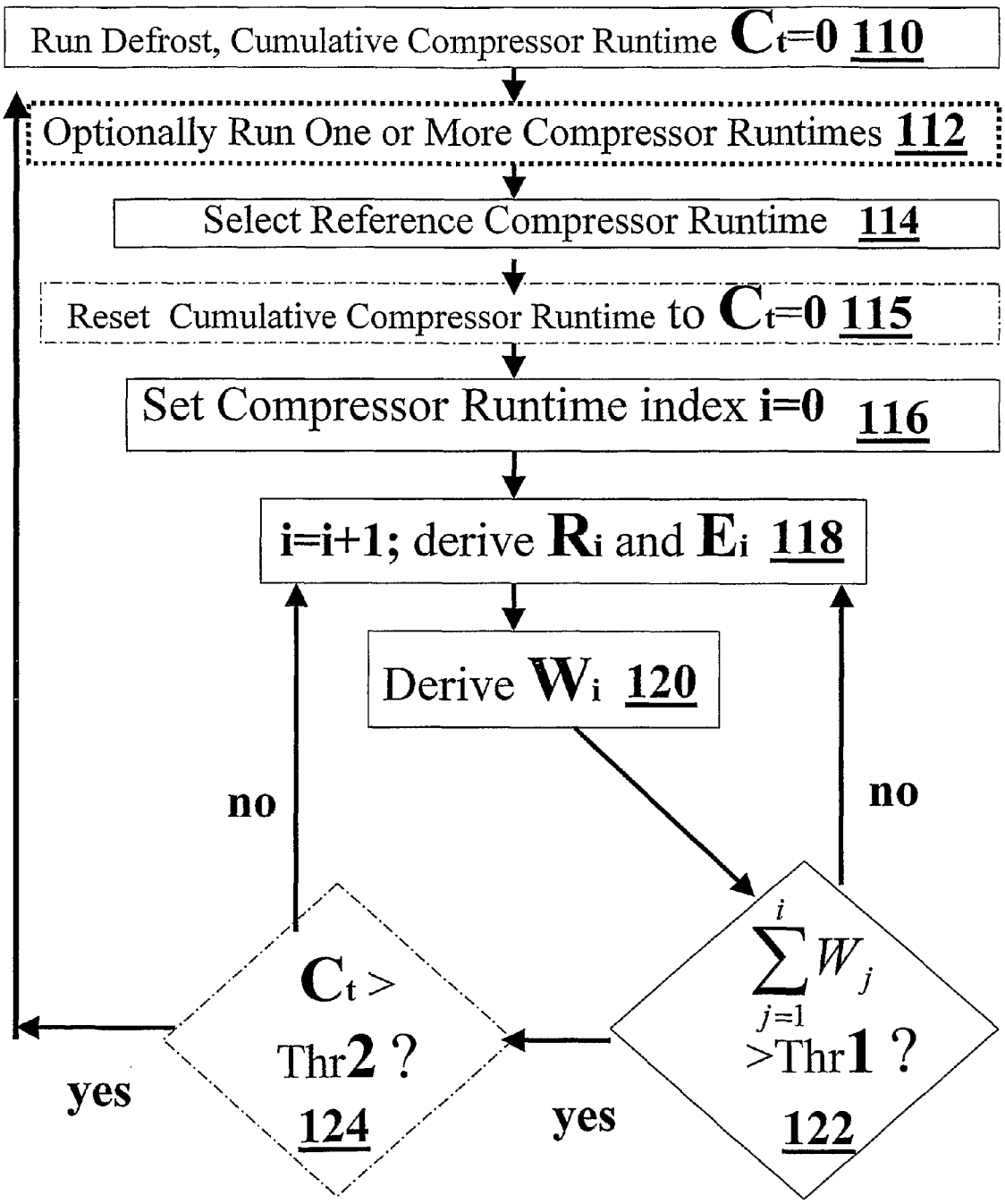
FIG. 1-4 provide flow charts of defrost algorithms in accordance with exemplary embodiments of the present invention.

Reference will now be made to FIG. 1 which provides a flow chart of a defrost timing algorithm in accordance with some embodiments of the prevent invention.

Thus, after running of a previous defrost 110, such as a most recent defrost, the cumulative compressor runtime $C_t$ is set to zero. Although there is no other explicit reference to $C_t$ other than that of step 110 in FIGS. 1-4, it is assumed throughout FIGS. 1-4 that for every compressor runtime, $C_t$ is appropriately incremented by the value of the runtime.

After the defrost, one or more compressor runtimes are carried out 112 before appropriate selection of a reference compressor runtime. In some embodiments, the selected reference compressor runtime is a minimal runtime.

Not wishing to be bound by any particular theory, it is noted that for many refrigeration systems the minimal runtime is not necessarily that first runtime after defrosting. Although during the first runtime after defrosting it is likely that the amount of frost accumulated on the evaporator is indeed at or near a minimum, in many systems the recent defrost has raised the ambient temperature within the refrigeration unit, and thus the compressor is forced to run for extra time in order to appropriately cool the unit. Furthermore, it is noted that although selection of the first runtime after defrost can be a poor reference runtime selection for certain systems under certain circumstances, the present invention in no way precludes selection of the first compressor runtime after a previous or most recent defrosting.

In some embodiments, an early reference runtime is selected. As used herein, an early runtime is a runtime that occurs relatively recently after a previous defrosting. In some embodiments, for an early runtime it is thought that the quantity or level of frost on the evaporator is relatively minimal. Thus, in various embodiments, the first, second, third or fourth compressor runtime after defrosting is selected. Selection of an early runtime for a particular system is within the scope of the knowledge of the skilled artisan, and it will be appreciated that in some embodiments, more than one selection of an early runtime is appropriate. In some embodiments, an early runtime is selected according to a time where the frost on the evaporator is near minimal levels and the refrigeration unit has had an opportunity to cool from a previous or most recent defrost.

Furthermore, it is noted that in some embodiments, the reference compressor cycle may be selected more than once, and then a most recently selected compressor run cycle can be used during the rest of the defrost algorithm. More details of specific embodiments of this option are presented in the figures.

After selection of the reference compressor runtime 114, the compressor runtime index is set zero 116, and is incremented 118 for subsequent runtimes.

Optionally, the value of the cumulative compressor runtime $C_t$ is reset to zero in optional step 115.

As used herein, a runtime within a compressor cycle is a substantially continuous time interval wherein the compressor is running. In many examples, the compressor runs continuously during a given runtime, though it is recognized that substantially negligible interruptions during a compressor runtime do not necessarily divide a single compressor runtime into a plurality of compressor runtimes. It is known that compressor cycles are composed of compressor runtimes and compressor-resting times, wherein the duration of the compressor runtime is indicative, in some embodiments, is related to the amount of energy expended during the runtime.

For each compressor runtime (the ith runtime) subsequent to the reference compressor runtime, the duration of the runtime $R_i$ as well as the expended energy parameter of the runtime $E_i$ are derived (step 118). Furthermore, for each compressor runtime (the ith runtime), the wasted energy parameter $W_i$ of the specific runtime is derived (step 120), wherein the wasted energy parameter is related to the excess compressor running time relative to the reference compressor runtime of the ith compressor runtime after the reference compressor runtime. In some embodiments, this relation is governed in part by a load factor of the refrigeration unit. In some embodiments, this relation is a linear relation.

After deriving a wasted compressor runtime or wasted compressor energy parameter for a particular compressor runtime within a particular compressor cycle, the total or sum or aggregate of the wasted compressor energy parameter is compared (step 122) to a first threshold value (thr1). In the event that the total or sum or aggregate does not exceed the first threshold value, a defrost command is not sent at that particular time, and the refrigeration unit is allowed to enter another compressor runtime (step 118) without first sending a defrost command.

In some embodiments, the first threshold value is a predetermined constant related to the specific properties and/or environment of the refrigeration units. The skilled artisan can select the appropriate threshold value. In some embodiments, the threshold value (thr1) is related to a defrost energy parameter of the refrigeration unit, wherein the relationship between the absolute defrost energy of the refrigeration unit and the defrost energy parameter of the refrigeration unit is substantially identical to a relation between an expended energy parameter of the compressor and an absolute expended energy of the compressor or the relation between a wasted energy parameter of the compressor and an absolute wasted energy of the compressor. Thus, in some embodiments, the threshold value (thr1) is set to be the defrost energy parameter of the refrigeration unit. In some systems, it is recognized that there will be variations, and thus in some embodiments, the threshold value is set to be within 30% of a defrost energy parameter of the refrigeration unit.

Furthermore, it is noted that the specific notion of a predetermined constant for thr1 is by no means a limitation of the present invention. In some embodiments, the specific value of thr1 is adaptable and can change during the operation of the refrigeration unit, or can be specifically set by a user or service technician. In some embodiments, the specific value of thr1 adapts according to historical data about refrigeration system, wherein adaptations or adjustment of thr1 is within the realm of the skilled artisan.

In the event that step 122 indicates that the total or aggregate or sum or total of wasted energy parameters of compressor runtimes exceeds the threshold Thr1 (threshold 1), it is possible in certain embodiments to send the defrost command to the defrost header. Optionally, as illustrated in step 124 of FIG. 1, the sending of the defrost command is conditionally on the accumulated compressor runtime since a previous or most recent defrost exceeding a second threshold value Thr2.

It is noted that there are specific situations wherein it is possible that the derived compressor wasted energy parameter includes factors other than frosting of the evaporator, and there is a need for corrections. Exemplary such factors include but are not limited to insertion of warm food or beverage into the refrigeration unit and a long time period where the door is left open. In some situations, merely comparing what is derived as the total or aggregate wasted energy to a first threshold (thr1) might lead to a situation where a defrost command is erroneously sent too early, when less than the requisite amount of frost on the evaporator is hindering the efficiency of the compressor. For example, if a door is open in inordinate amount of time between a first and second compressor runtime, it is possible that the extra long second compressor runtime misleads the system into overestimating the wasted energy parameter of the second compressor runtime, thereby triggering a premature defrost.

Thus, for certain embodiments of the invention corrective measures are employed such as those of steps 142A, 142B and 144 for avoiding or reducing the likelihood of premature defrosts due to inaccurate estimation of compressor waste energy parameters of one or more run-cycles. Not wishing to be bound by any particular theory, it is noted that the need for correction derives from the fact that the derived wasted energy parameters are not truly indicative of waste due to accumulation of frost on the evaporator, but due to external factors which are not waste per se. Certain embodiments of the present invention provide the filtering out of these external factors by correcting the erroneous wasted energy parameters.

Note that the technique of using the accumulated compressor runtime since a last defrost is just one example of a technique for correcting for overestimation of compressor runtime. Thus, another possible example is to measure open door times of the refrigeration unit, and to adjust accordingly.

Figure 2:
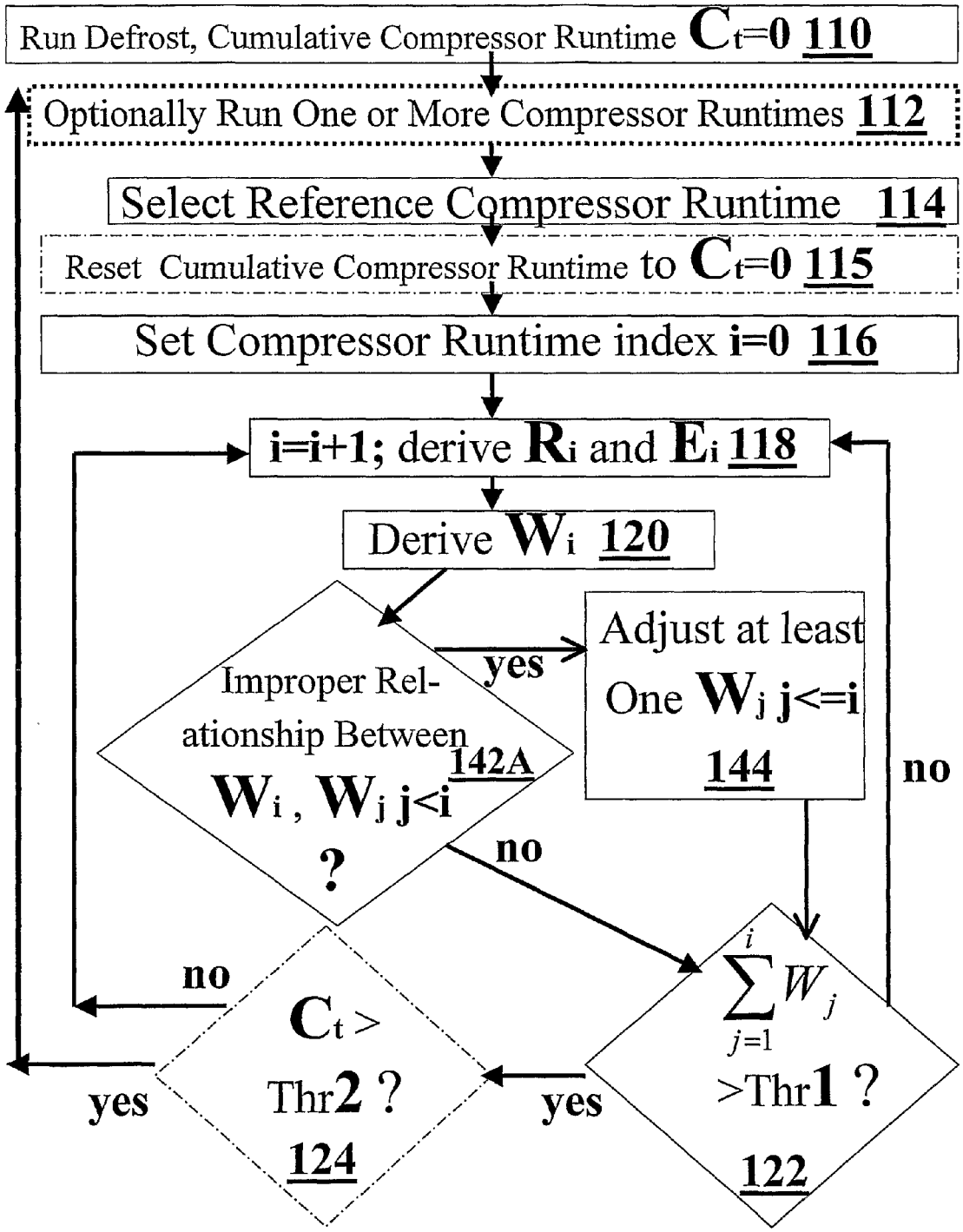

Another possible technique for adjusting or correcting derived values of wasted compressor energy parameters of one or more runtimes (derived in step 118) is illustrated in steps 142A of FIG. 2. Thus, in the event that an improper relationship is detected between a wasted energy parameter $W_i$ of a current compressor runtime and wasted energy parameter $W_j$ of one or more previous compressor runtimes ($j<i$) of one or more previous compressor cycles, it is possible to correct retroactively the value of at least one derived wasted energy parameters.

Thus, in some embodiments it is concluded that certain measurements or estimations of compressor waste energy parameters for one or more compressor runtimes are incorrect due to factors other than the true defrost situation of evaporator, and one or more of these values are corrected to better reflect the true defrost situation of evaporator. One exemplary such indication is a decrease in derived compressor energy parameters over time and/or a decrease in compressor runtimes from one runtime to a later runtime (see FIG. 4, step 142*b*, see the discussion in example 3).

The skilled artisan will appreciate that there are many techniques known on the art that may be useful for deriving inappropriate relationships between one or more derived wasted energy parameters of compressor runtimes. Exemplary such techniques include but are not limited to statistical techniques, data mining technique, fuzzy logic techniques, and machine learning techniques. In some embodiments, these techniques are augmented by other measured data of the refrigeration unit, including but not limited to ambient environment parameters, environment parameters of the inside of the refrigeration unit, current loads on the compressor, and the like.

Figure 3:
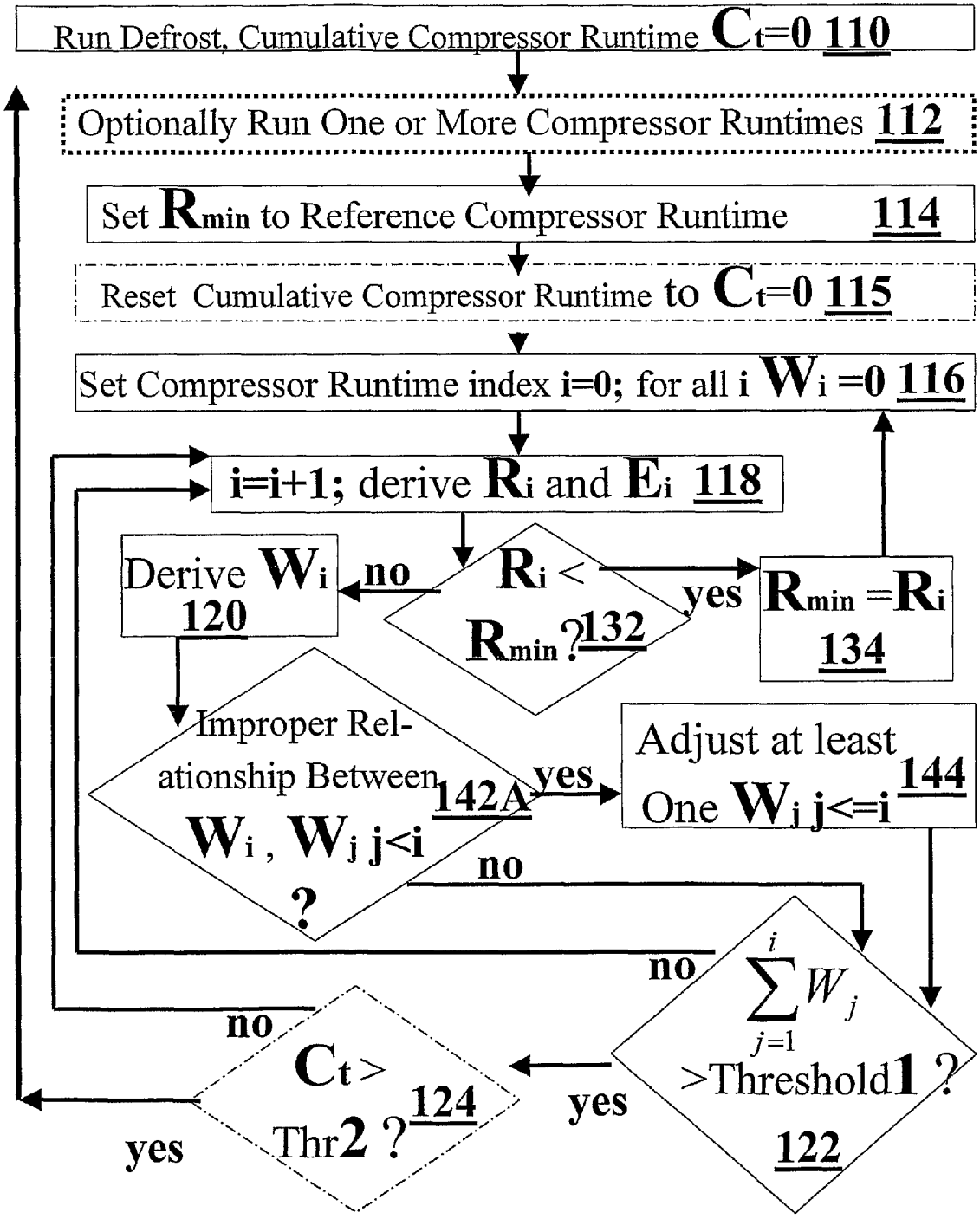
Figure 4:
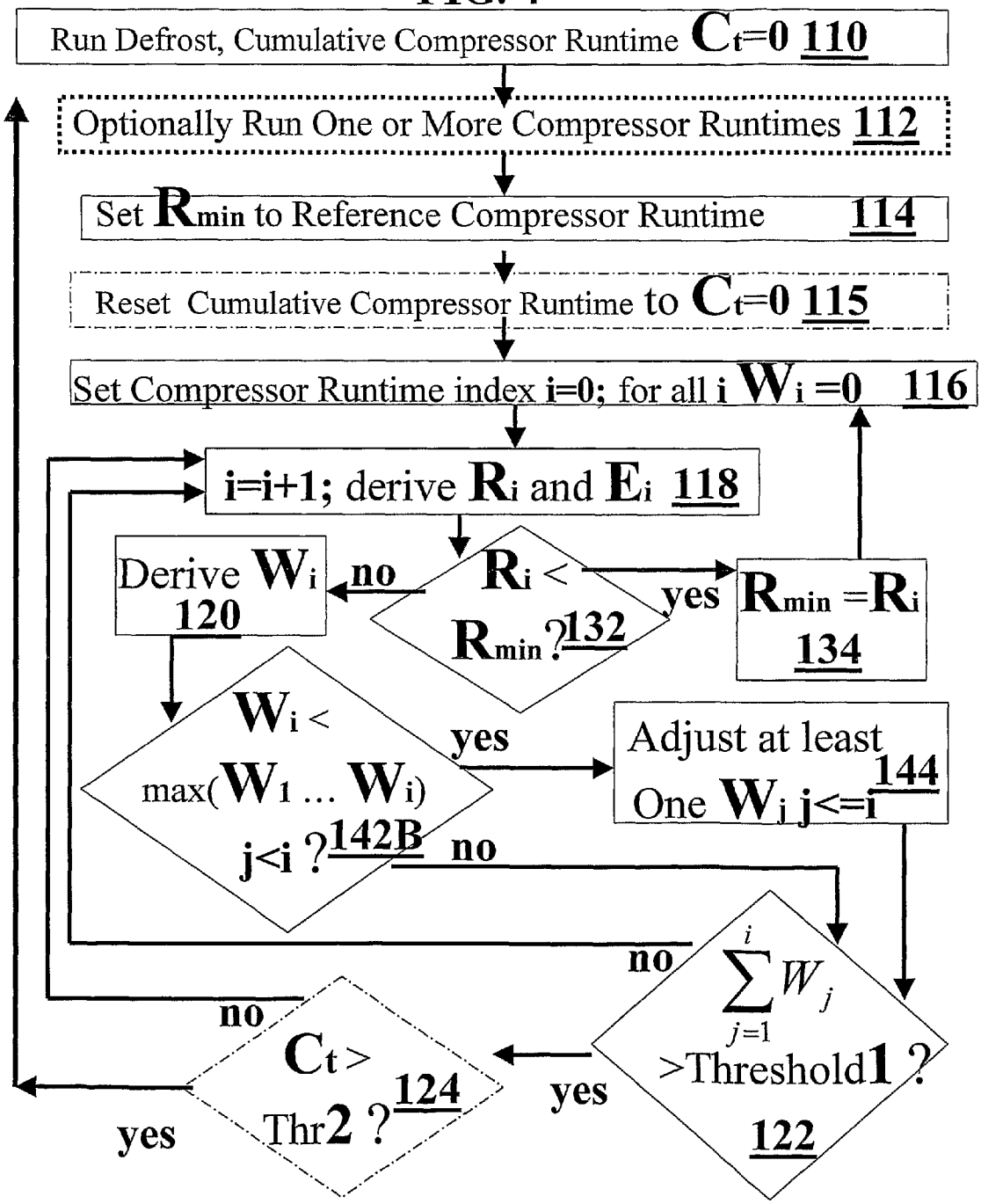

FIG. 3 provides a flowchart of an exemplary algorithm wherein a reference compressor run time can be selected a first time, and then re-selected during a latter compressor runtime. As illustrated in FIG. 3, the reference compressor runtime is selected to be the minimum compressor runtime (runtime of minimum duration) after a given defrosting.

Thus, referring to FIG. 3 it is noted that after a defrost (step 110), the minimum reference runtime is assumed (step 114) to be a specific runtime after defrosting, and the variable $R_{min}$, reflecting the candidate minimum compressor runtime or minimum energy compressor runtime is set to the length of runtime for this reference runtime. For subsequent runtimes (step 116), the duration of the runtime $R_i$ is measured (step 118) as well as an expended energy parameter $E_i$ of the runtime.

In the event that (step 132) the ith runtime is shorter than the reference runtime (the candidate minimum $R_{min}$), the ith runtime is selected as the new candidate runtime (step 134), all wasted energy parameter variables $W_i$ are reset to zero (step 116), and the compressor runtime index is reset to zero as well.

Alternatively, it is assumed for the time being that the candidate reference runtime is indeed valid, and it is possible to compute a wasted energy parameter of the current (ith) runtime (step 120).

Figure 5:
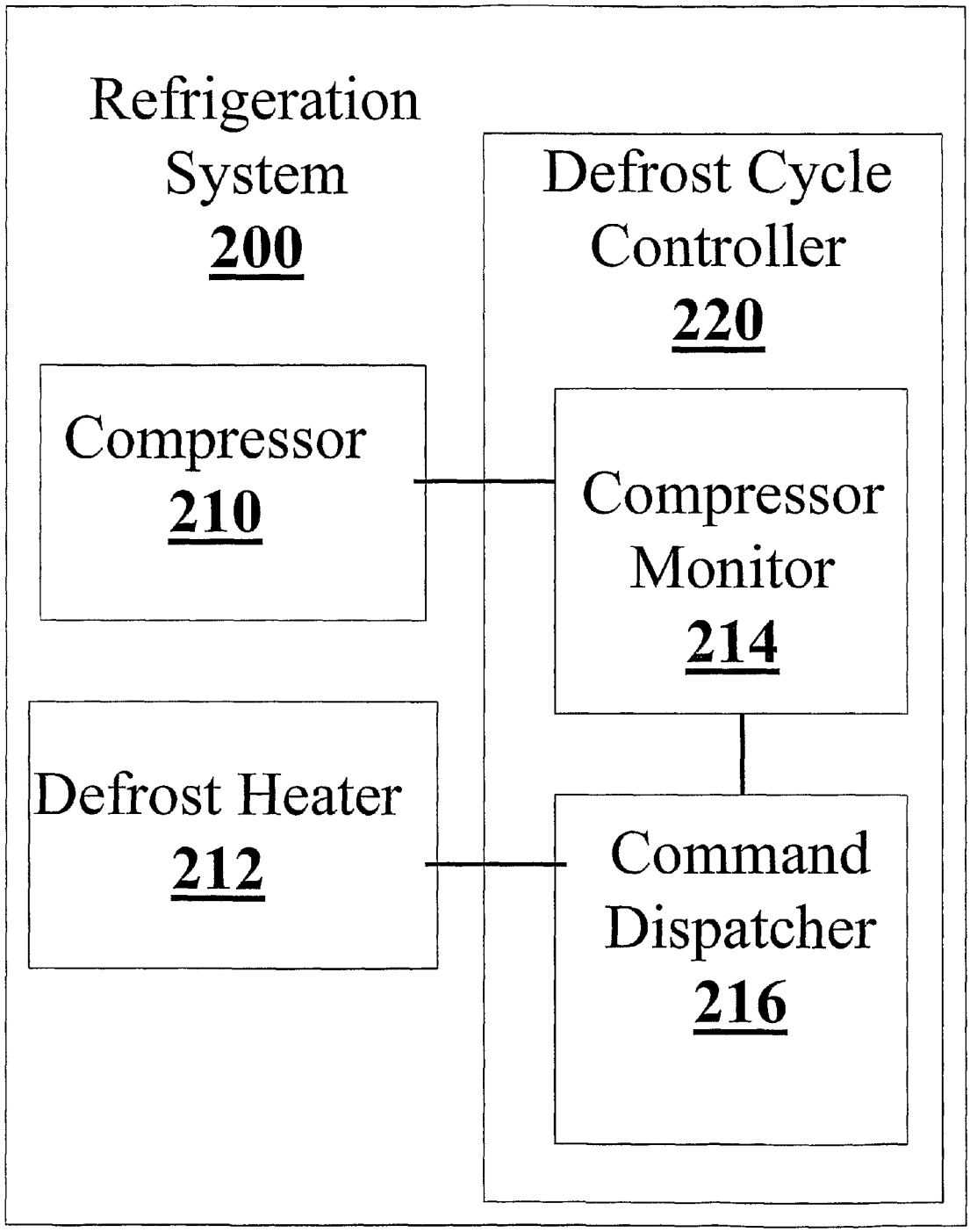
FIG. 5 provide a block diagram of an exemplary defrost cycle controller and an exemplary refrigeration system according exemplary embodiments of the invention.

FIG. 5 provides a block diagram of an exemplary diagram of Refrigeration System 200 according to some embodiments of the present invention. As illustrated in FIG. 5, a defrost cycle controller 220 monitors a compressor 210 of the refrigeration unit using a compressor monitor 214. A command dispatcher 216 of the defrost cycle controller 220 issue appropriate defrost commands to the defrost header 212. It is stressed that according to different embodiments of the present invention, the defrost cycle controller is operative to issue defrost commands in according to any of method disclosed herein. It will be appreciated that, in different embodiments, for the defrost cycle controller 220 to issue the defrost commands according to any of method disclosed herein, the defrost controller 220 will include appropriate software, hardware, firmware (not shown) and/or any combination thereof.

It is noted that the refrigeration system can include any refrigerated devices having cooled enclosures such as refrigerators, freezers and refrigerated display cases.

The following examples are to be considered merely as illustrative and non-limiting in nature. It will be apparent to one skilled in the art to which the present invention pertains that many modifications, permutations, and variations may be made without departing from the scope of the invention.

EXAMPLE 1

An Exemplary Technique for Calculating Cumulative Compressor Runtime and a Total Compressor Energy Waste Parameter Assume a plurality of compressor cycles after a given defrosting, where each compressor cycle includes both compressor runtime as well as a time interval where the compressor is inactive. During the $i^{th}$ compressor cycle, the compressor runtime is given by $R_i$ and the expended energy parameter is given by $E_i$.

After J compressor runtimes, the cumulative compressor runtime since the first compressor runtime is given by:

$$C_t = \sum_{i=1}^{J} R_i \tag{1}$$

From the sequence of J compressor runtimes $\{R_1, R_2 \ldots R_J\}$, the $K^{th}$ runtime is selected as a minimum energy compressor runtime and we define $R_{min}$ by:

$$R_{\min} \stackrel{def}{=} R_K. \tag{2}$$

Note that the energy expended parameter for the minimum energy compressor runtime is given by $E_{min}$.

Thus, for a given compressor runtime $R_i$ later than the $K^{th}$ runtime, the waste $W_i$ is given as $$W_i = E_i - E_{min}$$

where $E_i$ is the expended energy parameter in the ith cycle, and $E_{min}$ is the expended energy parameter of the reference runtime.

The total compressor waste for runtimes after the $K^{th}$ runtime is thus given by:

$$T_W = \sum_{i=K+1}^{J} W_i \tag{4}$$

EXAMPLE 2

Theoretical Discussion

The following theoretical analysis is provided for illustrative purposes only, and in no way is intended to limit the scope of the invention beyond limitations specifically recited in the claims. Furthermore, it is noted that although certain assumptions of a refrigeration unit are introduced in the present example, the example provided herein in no way limits the present invention to refrigeration units for which these assumptions are presumed valid.

Consider a refrigeration unit in an environment where frost builds up on the evaporator. As ice builds up on the evaporator, the compressor is less efficient. Over time, the ice on the evaporator thickens, and the instantaneous rate of compressor energy waste due to ice concomitantly increases. Defining y as the instantaneous rate of compressor energy waste, it is thus possible to write $$y = func_1(\text{amount_of_frost}) \tag{5}$$

implying that the instantaneous rate of compressor energy waste is a function (func1) of the amount or thickness of frost on the evaporator. Since the amount of frost or thickness of frost on the evaporator is, in the absence of a defrost or other activity, an increasing a function of time, y can be written as a function of time $$y = func_2(t) \tag{6}$$

In some situations, it is possible to assume that (6) is a linear relationship, yielding $$y = at + b \tag{7}$$

It is noted that for many systems, equation (7) is valid as long as an inordinate amount of ice does not accumulate on the evaporator. Not wishing to be bound by any particular theory, it is nevertheless noted that this approximation is in reality a valid approximation of many refrigeration units, especially those which are appropriately defrosted. In some systems, as the amount of ice increases without an appropriate defrost, the actual instantaneous compressor waste deviates from formula (7), and can increase asymptotically if there is never a later defrost. Once again, it is noted that in many systems, especially those appropriately defrosted, this is a rare or nonexistent case. For this particular example, the total amount of compressor waste from time=0 through a time T is given as $$Y = \frac{1}{2}aT^2. \tag{8}$$

Assuming that the cost of a single defrost is given by D, and that the refrigeration unit is defrosted after a time T, the excess cost that humidity and frosting imposes on the refrigeration unit, a cost which includes the cost of compressor waste and the cost of defrosting, for the time interval [0, T] is given by:

$$\text{Excess_Cost_Humidity} = \frac{1}{2}aT^2 + D. \tag{9}$$

Furthermore, the excess cost per unit time for the specific case where the refrigeration unit is defrosted after a time T is given by $$\text{Excess_Cost_Humidity_Per_Unit_Time} = \frac{1}{2}aT^2 + \frac{D}{T}. \tag{10}$$

The function of equation (10) is minimized when the derivative is zero, implying:

$$D = \frac{1}{2}aT^2. \tag{11}$$

Inspecting of equations (8) and (11) yields the result that the excess cost of refrigeration unit operation imposed by buildup of ice on the evaporator unit is minimized when the aggregate wasted energy of the compressor, given by the right hand side of (11), equals the cost of a single defrost, given by the left hand side of equation (11).

Not wishing to be bound by any particular theory, it is noticed that inspection of equation 10 reveals that for the particular situation where a vanishes, there is no frost accumulation on the evaporator, and equation (10) is minimized by choosing an infinite value of T. This choice of T implies a situation where no command is sent to the defrost heater.

EXAMPLE 3

Sample Data

In this example, sample data is presented for a series of 7 runtimes from 7 compressor cycles after a defrost cycle.
Runtime A 40 minutes, expended energy parameter of Runtime A 400 units,
Runtime B 30 minutes, expended energy parameter of Runtime B 300 units,
Runtime C 35 minutes, expended energy parameter of Runtime C 350 units,
Runtime D 50 minutes, expended energy parameter of Runtime D 500 units,
Runtime E 52 minutes, expended energy parameter of Runtime E 520 units,
Runtime F 40 minutes, expended energy parameter of Runtime F 400 units,
Runtime G 47 minutes, expended energy parameter of Runtime G 470 units,
In our example, Threshold1 is 499 units and Threshold2 is 240 minutes.
The Algorithm of FIG. 4 as Applied to the Sample Data
1) After runtime A we assign $R_{min}$ to be 40 minutes in accordance with 114.
We assign i=0 and all Wi=0 in accordance with 116.
2) After runtime B, note that the compressor runtime decreased (step 132) from 40 minutes to 30 minutes, and thus we set the minimum runtime to 30 minutes (step 134), and reset i=0 all values of Wi=0 in accordance with step 116.
3) After runtime C, we derive in step 120 W1 to be 350 units−300 units=50 units. Because the maximum of all previous Wi is 0 (step 142B) there is no need to adjust any of the Wi. In step 122 we note that the sum of all Wj is 50 units, which is less than threshold 1 (step 122).
3) After runtime D, we derive in step 120 W2 to be 500 units−300 units=200 units. Because the maximum of all previous Wi is 50 (step 142B) there is no need to adjust any of the Wi. In step 122 we note that the sum of all Wj is 250 units, which is less than threshold 1 (step 122).
3) After runtime E, we derive in step 120 W3 to be 520 units−300 units=220 units. Because the maximum of all previous Wi is 200 (step 142B) there is no need to adjust any of the Wi. In step 122 we note that the sum of all Wj is 30+200+220=440 units, which is less than threshold 1 (step 122).
4) After runtime F, we derive in step 120 W4 to be 400 units−300 units=100 units.
Thus, we adjust all previous Wi (e.g. only W1) to be no greater than 100 units. In this case, we adjust W2 from 200 units to 100 units and we adjust W3 from 220 units to 100 units in step 144. The sum of all Wi is now 30+100+100+100=330 units which is less than the threshold1 (step 122).
5) After runtime G, we derive in step 120 W5 to be 470 units−300 units=170 units. Because the maximum of all previous Wi is 100 (step 142B) there is no need to adjust any of the Wi. In step 122 we note that the sum of all Wj is 30+100+100+100+170=500 units, which is greater than the threshold of 499 units (step 122). Also, the cumulative compressor runtime is 294 minutes, which exceeds the thr/threshold2 of 240 minutes (step 124). Thus, we send a defrost command to the defroster (step 110).

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art. The scope of the invention is limited only by the following claims.

The invention claimed is:

1. A method of defrosting a refrigeration unit having a compressor, a defrost heater and an evaporator, the method comprising:
a) deriving a total wasted energy parameter of the compressor for at least one time interval;
b) at a time determined at least in part by said derived total wasted energy of the compressor issuing a defrost command to the defrost heater,
wherein said deriving of said total wasted energy includes: i) choosing a reference runtime; ii) estimating an expended energy parameter of the compressor during said reference runtime; and iii) for a plurality of later runtimes, incrementing said total wasted energy parameter by a difference between an expended energy parameter of the compressor during said later runtime and said expended energy parameter of the compressor during said reference runtime and
wherein said reference runtime is chosen to be a minimum energy runtime after a previous defrosting of the refrigeration unit.

2. The method of claim 1 wherein said choosing of said minimum energy runtime includes: i) designating a runtime to be a candidate minimum energy runtime; ii) deriving an expended energy parameter of a runtime later than said candidate runtime; iii) if said expended energy parameter of said later runtime is less than an energy parameter of said candidate minimum energy runtime, designating said later runtime as said minimum energy runtime.

3. The method of claim 2 wherein upon designating said later runtime as said minimum energy runtime, said total wasted energy parameter is reset.

4. A method of defrosting a refrigeration unit having a compressor, a defrost heater and an evaporator, the method comprising:
a) deriving a total wasted energy parameter of the compressor for at least one time interval;
b) at a time determined at least in part by said derived total wasted energy of the compressor issuing a defrost command to the defrost heater,
wherein said deriving of said total wasted energy includes: i) choosing a reference runtime; ii) estimating an expended energy parameter of the compressor during said reference runtime; and iii) for a plurality of later runtimes, incrementing said total wasted energy parameter by a difference between an expended energy parameter of the compressor during said later runtime and said expended energy parameter of the compressor during said reference runtime and wherein said reference runtime is chosen to be runtime having a said expended energy parameter that is at most 30% greater than a said expended energy parameter of a minimum energy compression cycle after a previous defrosting of the of the refrigeration unit.

5. A method of defrosting a refrigeration unit having a compressor, a defrost heater and an evaporator, the method comprising:

a) deriving a total wasted energy parameter of the compressor for at least one time interval;

b) at a time determined at least in part by said derived total wasted energy of the compressor issuing a defrost command to the defrost heater, wherein said deriving of said total wasted energy includes: i) choosing a reference runtime; ii) estimating an expended energy parameter of the compressor during said reference runtime; and iii) for a plurality of later runtimes, incrementing said total wasted energy parameter by a difference between an expended energy parameter of the compressor during said later runtime and said expended energy parameter of the compressor during said reference runtime and wherein said reference compressor cycle is chosen to be an early compressor cycle after a previous defrosting of the refrigeration unit.

6. A defrost cycle controller for a refrigeration unit including a compressor, a defrost heater, an evaporator, the controller comprising:

a) a compressor monitor operative to derive a total wasted energy parameter of the compressor for at least one time interval;

b) a command dispatcher adapted to issue defrost commands to the defrost heater at a time determined at least in part by said derived total wasted energy of the compressor, wherein said compressor monitor is operative such that said deriving of said total wasted energy includes: i) choosing a reference runtime; ii) estimating an expended energy parameter of the compressor during said reference runtime; and iii) for a plurality of later runtimes, incrementing said total wasted energy parameter by a difference between an extended energy parameter of the compressor during said later runtime and said expended energy parameter of the compressor during said reference runtime and wherein said compressor monitor is operative such that said reference runtime is chosen to be a minimum energy runtime after a previous defrosting of the refrigeration unit.

7. The defrost cycle controller of claim 6 wherein said compressor monitor is operative such that said choosing of said minimum energy runtime includes: i) designating a runtime to be a candidate minimum energy runtime; ii) deriving an expended energy parameter of a runtime later than said candidate runtime; iii) if said expended energy parameter of said later runtime is less than an energy parameter of said candidate minimum energy runtime, designating said later runtime as said minimum energy runtime.

8. The defrost cycle controller of claim 7 wherein said compressor monitor is operative such that upon designating said later runtime as said minimum energy runtime, said total wasted energy parameter is reset.

9. A defrost cycle controller for a refrigeration unit including a compressor, a defrost heater, an evaporator, the controller comprising:

a) a compressor monitor operative to derive a total wasted energy parameter of the compressor for at least one time interval;

b) a command dispatcher adapted to issue defrost commands to the defrost heater at a time determined at least in part by said derived total wasted energy of the compressor, wherein said compressor monitor is operative such that said deriving of said total wasted energy includes: i) choosing a reference runtime; ii) estimating an expended energy parameter of the compressor during said reference runtime; and iii) for a plurality of later runtimes, incrementing said total wasted energy parameter by a difference between an expended energy parameter of the compressor during said later runtime and said expended energy parameter of the compressor during said reference runtime and wherein said compressor monitor is operative such that said reference runtime is chosen to be runtime having a said expended energy parameter that is at most 30% greater than a said expended energy parameter of a minimum energy compression cycle after a previous defrosting of the refrigeration unit.

10. A defrost cycle controller for a refrigeration unit including a compressor, a defrost heater, an evaporator, the controller comprising:

a) a compressor monitor operative to derive a total wasted energy parameter of the compressor for at least one time interval;

b) a command dispatcher adapted to issue defrost commands to the defrost heater at a time determined at least in part by said derived total wasted energy of the compressor, wherein said compressor monitor is operative such that said deriving of said total wasted energy includes: i) choosing a reference runtime; ii) estimating an expended energy parameter of the compressor during said reference runtime; and iii) for a plurality of later runtimes, incrementing said total wasted energy parameter by a difference between an expended energy parameter of the compressor during said later runtime and said expended energy parameter of the compressor during said reference runtime and wherein said compressor monitor is operative such that said reference compressor cycle is chosen to be an early compressor cycle after a previous defrosting of the refrigeration unit.

11. A computer readable non-transitory storage medium having computer readable code embodied in said computer readable storage medium, said computer readable code comprising instructions for:

a) deriving a total wasted energy parameter of a compressor of a refrigeration unit having a compressor, a defrost heater, and an evaporator, for at least one time interval;

b) at a time determined at least in part by said derived total wasted energy of the compressor issuing a defrost command to said defrost heater of said refrigeration unit, wherein said computer readable code further comprises instructions for: i) choosing a reference runtime; ii) estimating an expended energy parameter of said compressor during said reference runtime; and iii) for a plurality of later runtimes, incrementing said total wasted energy parameter by a difference between an expended energy parameter of the compressor during said later runtime and said expended energy parameter of the compressor during said reference runtime and wherein execution of said instructions is operative such that said reference runtime is chosen to be a minimum energy runtime after a previous defrosting of said refrigeration unit.

12. The computer readable storage medium of claim 11 wherein execution of said instructions is operative such that said choosing of said minimum energy runtime includes: i) designating a runtime to be a candidate minimum energy runtime; ii) deriving an expended energy parameter of a runtime later than said candidate runtime; iii) if said expended energy parameter of said later runtime is less than an energy parameter of said candidate minimum energy runtime, designating said later runtime as said minimum energy runtime.

13. The computer readable storage medium of claim 12 wherein execution of said instructions is operative such that upon designating said later runtime as said minimum energy runtime, said total wasted energy parameter is reset.

14. A computer readable non-transitory storage medium having computer readable code embodied in said computer readable storage medium, said computer readable code comprising instructions for:

a) deriving a total wasted energy parameter of a compressor of a refrigeration unit having a compressor, a defrost heater, and an evaporator, for at least one time interval;

b) at a time determined at least in part by said derived total wasted energy of the compressor issuing a defrost command to said defrost heater of said refrigeration unit, wherein said computer readable code further comprises instructions for: i) choosing a reference runtime; ii) estimating an expended energy parameter of said compressor during said reference runtime; and iii) for a plurality of later runtimes, incrementing said total wasted energy parameter by a difference between an expended energy parameter of the compressor during said later runtime and said expended energy parameter of the compressor during said reference runtime and wherein execution of said instructions is operative such that said reference runtime is chosen to be runtime having a said expended energy parameter that is at most 30% greater than a said expended energy parameter of a minimum energy compression cycle after a previous defrosting of the refrigeration unit.

15. A computer readable non-transitory storage medium having computer readable code embodied in said computer readable storage medium, said computer readable code comprising instructions for:

a) deriving a total wasted energy parameter of a compressor of a refrigeration unit having a compressor, a defrost heater, and an evaporator, for at least one time interval;

b) at a time determined at least in part by said derived total wasted energy of the compressor issuing a defrost command to said defrost heater of said refrigeration unit, wherein said computer readable code further comprises instructions for: i) choosing a reference runtime; ii) estimating an expended energy parameter of said compressor during said reference runtime; and iii) for a plurality of later runtimes, incrementing said total wasted energy parameter by a difference between said expended energy parameter of the compressor during said later runtime and said expended energy parameter of the compressor during said reference runtime and wherein execution of said instructions is operative such that said reference compressor cycle is chosen to be an early compressor cycle after a previous defrosting of the refrigeration unit.

* * * * *